United States Patent [19]

Sadamatsu et al.

[11] 4,315,980

[45] Feb. 16, 1982

[54] ELECTROPHOTOGRAPHIC MEMBER WITH METALLOCENE CONTAINING OVERLAYER

[75] Inventors: Shigeru Sadamatsu; Kohichi Yamamoto; Kazuaki Ohmi, all of Minami-ashigara, Japan

[73] Assignee: Fuji Xerox Co., Ltd., Tokyo, Japan

[21] Appl. No.: 137,191

[22] Filed: Apr. 4, 1980

[30] Foreign Application Priority Data

Apr. 9, 1979 [JP] Japan ..... 54-42118

[51] Int. Cl.[3] ..... G03G 5/14

[52] U.S. Cl. ..... 430/58; 430/66; 430/900

[58] Field of Search ..... 430/58, 66, 67, 900

[56] References Cited

U.S. PATENT DOCUMENTS

| | | | |
|---|---|---|---|
| 3,434,832 | 3/1969 | Joseph et al. | 430/66 X |
| 3,928,034 | 12/1975 | Regensburger | 430/58 X |
| 3,966,471 | 6/1976 | Hasegawa et al. | 430/66 X |
| 3,989,520 | 11/1976 | Rochlitz | 430/58 |
| 4,147,541 | 4/1979 | Lindblad et al. | 430/67 X |

FOREIGN PATENT DOCUMENTS

| | | | |
|---|---|---|---|
| 2452622 | 5/1976 | Fed. Rep. of Germany | 430/66 |

*Primary Examiner*—Roland E. Martin, Jr.
*Attorney, Agent, or Firm*—Sughrue, Mion, Zinn, Macpeak and Seas

[57] ABSTRACT

An electrophotographic member in which a photoconductive layer and a protective layer are superposed in order on a photoconductive support, wherein the improvement comprises:

said protective layer containing at least one metallocene or a compound having at least one metallocene nucleus in its molecular structure.

10 Claims, No Drawings

ELECTROPHOTOGRAPHIC MEMBER WITH METALLOCENE CONTAINING OVERLAYER

BACKGROUND OF THE INVENTION

1. Field of the Invention

This invention relates to an electrophotographic member capable of yielding an image of good quality incorporating a metallocene compound in a protective layer provided on the surface of a photoconductive layer.

2. Description of the Prior Art

A number of photosensitive members have been practically applied in electrophotographic systems including processes comprising charging, exposing and developing procedures (see, for example, U.S. Pat. No. 2,297,691). For example, known photosensitive members include those which include a layer of organic photoconductive material directly formed on a conductive substrate by coating or vacuum deposition or those in which the organic photoconductive material is combined with an organic polymeric binder, those using inorganic photoconductive materials such as ZnO, CdS, $TiO_2$ and the like dispersed in a binder, those using vacuum-evaporated amorphous selenium and its alloys, and those wherein different types of photoconductive layers are superposed on one another (see, for example, Japanese Patent Publication Nos. 5394/70, 3005/71 and 14271/74). In order to ensure certain levels of both electrical and optical properties and mechanical properties or to improve and stabilize these properties, or in some cases to improve the characteristics required in a developing process, it has often been proposed to provide a protective layer on the photosensitive member surface.

Electrophotographic members having a surface layer on a photoconductive layer have been known in the art. One type of such surface layers is an electrically insulating surface layer composed of a highly electrically insulating material (e.g., see Tanaka, et al., U.S. Pat. No. 3,438,706 and Watanabe, et al., U.S. Pat No. 3,457,070). This is advantageous in that the thickness of the electrically insulating surface layer can be thickened and in that materials having high mechanical strength can be used. However, in order to repeatedly use an electrophotographic member with this type of surface layer, a specific latent image-forming process is required, such as: (A) first charging; second charging with an opposite polarity to that of the first charging; and imagewise exposure; or (B) first charging; second charging with opposite polarity and simultaneous imagewise exposure; and entire exposure, is required. Furthermore, the use of such a surface layer requires two or more charging steps per one copying step, which results in complicating the apparatus, unstable properties, and high production costs.

Another type of such surface layers is a protective layer composed of a relatively low electrically insulating material, i.e., a material having a low electric resistance. (See Joseph, U.S. Pat. No. 3,434,832 and Polastri, U.S. Pat. No. 4,006,020.) In most cases, however, the use of such a protective layer causes a high residual potential, and a great increase of cycle is required. These electric variations result in scumming and do not result in a clear reproduction image.

In order to avoid such problems, an additive has been incorporated in the protective layer or a single protective layer of a specific type has been used. However, most of these techniques have involved problems such as a loss of transparency which is essential to a protective layer, a loss of image sharpness under high humidity conditions or fogging in the background under low humidity conditions, a reduction in charging property of a photoconductive layer, and a cyclic build-up of residual potential, and can thus not be put into practice. This is because these methods have been directed merely to lowering the electric resistance of the protective layer or to improving its humidity dependence. In order to stabilize and ensure the charging property of the entire photoconductive layer over a long period of time under all practical conditions, various characteristics such as transport, injection and residence of the electric charges occurring on the surface of a protective layer and at the interface between the photoconductive layer and the protective layer must be collectively controlled. It is difficult to find a material which can improve these characteristics while controlling the electrical conductivity of the protective layer and which exhibits stable characteristics with variations in humidity and temperature. There has never been known a material, which when contained in a binder resin can satisfy the above-mentioned characteristics, and provide the mechanical strength necessary to meet the requirements of an ordinary protective layer.

SUMMARY OF THE INVENTION

It is a principal object of the present invention to provide an electrophotographic member having a protective layer which contains a compound capable of imparting the above-mentioned electrical characteristics and adequate mechanical strength to the protective layer.

In order to achieve the above object, extensive studies have been made and it has been found that an electrophotographic member attaining the above purpose can be obtained by adding to a protective layer at least one compound selected from the group consisting of metallocenes (i.e., biscyclopentadienyl complex salts), which have the general formula (I):

(I)

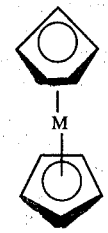

wherein M represents a metal atom and is, for example, selected from Fe, Ni, Co, V, Cr and Ti; and compounds having at least one metallocene nucleus in the molecular structure thereof, such as those having the formula (II):

(II)

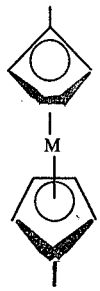

wherein M has the same meaning as defined above. Thus, the metallocene may be, e.g., an unsubstituted (I), or a substituted or polymeric (II) compound. Hereafter, these compounds are collectively referred to as metallocene compounds. That is, the inclusion of these compounds in the protective layer can eliminate a large dark decay of discharge potential frequently experienced in known members and can simultaneously suppress the residual potential after exposure to a sufficiently low level, making it possible to eliminate the cyclic build-up of residual potential. When the metallocene compounds used in the present invention are contained in the protective layer, their electrical conductivity is not changed by the charging or imagewise exposure steps, and they retain a substantially uniform latent image potential during repeated copying steps.

An electrophotographic member having a protective layer according to the present invention does not require a specific latent image-forming process as is required by some of the previously described prior art techniques, and is advantageous in that a latent image can be formed merely by uniform charging and imagewise exposure.

The protective layer also exhibits stable characteristics even though the ambient temperature and humidity vary. In addition, the present invention has a number of the additional advantages.

For example, while the thickness of a known protective layer is at most 5μ, the protective layer according to the invention can be made several times as thick. A conventional protective layer should have a relatively small thickness of about 0.1 to 5μ so as not to interfere with obtaining satisfactory electrical characteristics. Accordingly, the layer wears upon repeated use and its characteristics vary to a significant extent.

In the practice of the invention, the protective layer can be formed in a thickness as great as 15μ or 20μ, which up to now could not be considered possible from the viewpoint of imparting reasonable electrical characteristics, by incorporating the foregoing compounds or adjusting the concentration of the compound. In spite of such great thickness, a latent image can be formed by only uniformly charging an electrophotographic member of the present invention and imagewise exposure (i.e., the so-called Carlson process) without the use of any specific latent image-forming process such as first charging, second charging in the opposite polarity and imagewise exposure, or first charging, simultaneous imagewise exposure and second charging, and uniform exposure. As a matter of course, the protective layer according to the present invention can be made as thin as desired.

DETAILED DESCRIPTION OF THE INVENTION

The metallocenes and compounds having at least one metallocene nucleus in the molecular structure thereof contained in the protective layer of the invention include, for example, ferrocene, nickelocene, titanocene, vinylferrocene and their oligomers or polymers, diferrocenylphosphine, 1,1'-ferrocenebis-(diphenylphosphine), acetylferrocene, dibenzferrocene, dimethylaminoethyl ferrocene, methylaminoethyl ferrocene, methylaminomethyl ferrocene, ferrocenylacetonitrile, ferrocenylcarbonal, ferrocene sulfonic acid, diferrocenylethane, diferrocenylmethane, phenylferrocene, phenyl cyclopentaferrocene, benzoylferrocene, acetylferrocene, and the like. Among these metallocene compounds, ferrocene, nickelocene and titanocene are preferred, with ferrocene being particularly preferred, due to good stability thereof. These may be used alone or in combinations of two or more. These compounds are generally used in the protective layer in an amount of about 0.01 to 70 wt%, and preferably about 1 to 50 wt%, based on the weight of the protective layer.

The thickness of the protective layer ranges from about 0.5 to 50μ and is chosen within such range depending on the use of the electrophotographic member or the mechanical strength required for the protective layer.

The binder resins used in the protective layer of the electrophotographic member according to the invention may be any of the resins which have been used in this field. Desirable characteristics of the binder for the protective layer include: film-forming ability, mechanical strength, moisture resistance, corona resistance, good cleaning properties, chemical resistance, and good adhesiveness.

For example, mention can be made of polyurethane resins, polystyrene resins, polycarbonate resins, polyester resins, acrylic resins, silicone resins, vinyl chloride resins, polyvinyl acetate resins, cellulose ester resins, nitrocellulose resins, alkyd resins and the like.

Additives may be added to improve the adhesiveness or smoothness of the film. For example, silane coupling agents and adhesive polyester resins (e.g., Mylar® 49000) can also be used as additives to improve the adhesiveness, and silicon block copolymers, fatty acids (e.g., stearic acid) and metal salts of fatty acids (e.g., zinc stearate) can be used as additives to improve the smoothness of the film. Binder resins containing the $$-\underset{\underset{O}{\|}}{C}-$$

bond are particularly preferred, such as polyurethane resins, polycarbonate resins and polyester resins; it is believed that these binder resins form a charge transfer complex with ferrocene, thereby conferring the desired electrical characteristics.

If necessary, a thin intermediate layer may be provided below the protective layer to improve the electrical characteristics. The intermediate layer may be composed of an inorganic compound such as $SiO_2$, Se, S, $As_2O_3$, etc., or an organic compound such as polyester resins, epoxy resins, polyamide resins, polyurethane resins, nitrocellulose, vinylidene chloride resins, silicone resins, fluorine resins, etc. When the organic compound is used as the intermediate layer, both the electrical characteristics and the adhesion between the protective layer and the photoconductive layer are improved.

With respect to the thickness of the intermediate layer, it is sufficient that an exposed light transmits the photoconductive layer. A suitable thickness of the intermediate layer which can be used varies with the type of material used, but ranges from about 50 Å to 10 μm, preferably 100 Å to 1 μm.

In constructing the electrophotographic member according to the invention, a conductive substrate is first provided on which a photoconductive layer has been formed in the usual manner.

Examples of inorganic crystalline photoconductors useful in the present invention are cadmium sulfide, cadmium sulfoselenide, cadmium selenide, zinc sulfide, zinc oxide, and mixtures thereof. Examples of inorganic photoconductive glasses are amorphous selenium, and selenium alloys such as selenium-tellurium, and seleniumarsenic. Selenium may also be used in its hexagonal crystalline form, commonly referred to as trigonal selenium. Examples of organic photoconductors useful in the present invention are phthalocyanine pigments such as the X-form of metal free phthalocyanine described in Byrne, et al., U.S. Pat. No. 3,357,989, and metal phthalocyanine pigments, such as copper phthalocyanine. Other typical organic photoconductors include photoinjecting pigments such as benzimidazole pigments, perylene pigments, quinacridone pigments, indigoid pigments, and polynuclear quinones.

A coating of a metallocene dissolved in a binder resin solution at a suitable concentration is uniformly applied on the photoconductive layer using any of the widely employed techniques such as a spray coating, a dip coating or a coating using an applicator, after which the layer is dried.

Examples of solvents suitable for preparing the protective layer coating composition include dichloromethane, trichloromethane, tetrachloromethane, methyl ethyl ketone, isobutyl acetate, ethylbenzene, cyclohexanone, diacetone alcohol, diethylene glycol diethyl ether, dimethylformamide, dimethyl sulfoxide, "Amsco" Mineral Spirits 66/3, "Exxon" Aromatic Solvent 150, "Exxon" Aromatic Solvent 100, and so forth.

The thus fabricated electrophotographic member adequately satisfies all the characteristic requirements discussed hereinbefore.

Further, it has been found that the characteristics of the electrophotographic member are further improved by adding to the protective layer not only the metallocene or compound having at least one metallocene nucleus in the molecule thereof but also an electron acceptor, i.e., a compound exhibiting high electron affinity. The electron acceptor is added in an amount of from about 0.001 mol to 2 mols per mol of the metallocene compound. Incorporation of an electron acceptor method is known, for example, being described in British Pat. No. 1,337,227. The essential functions of the electron acceptor are that: (i) it activates the ferrocene compound, i.e., increases a cation radical density; (ii) the acceptor per se can become a carrier; and (iii) the acceptor can improve the mobility of electron. Suitable electron acceptors include, for example, anhydrides such as those of phthalic acid and tetrachlorophthalic acid, s-tricyanobenzene, picryl chloride, 2,4-dinitrochlorobenzene, 2,4-dinitrobromobenzene, 4-nitrobiphenyl, 4,4-dinitrobiphenyl, 2,4,6-trinitroanisole, trichlorotrinitrobenzene, trinitro-o-toluene, 4,6-dichloro-1,3-dinitrobenzene, p-dinitrobenzene, chloranyl, bromanyl, tetracyanoethylene, hexacyanobutadiene, tetracyanoquinodimethane, benzoquinone and their halogen- or cyano-substituted compounds, aromatic or heterocyclic compounds substituted with a nitro group ($—NO_2$), a sulfo ($—SO_3—$) group, a carboxyl group (—COOH), a cyano group (—CN) and the like, monomers or polymers of 2,4,7-trinitro-9-fluorenone, 2,4,5,7-tetranitrofluorenone, trinitroanthracene, dinitroacridine, tetracyanopyrene, and dinitroanthraquinone. Examples of aromatic or heterocyclic compounds which can be used in the present invention are dicyanodichlorobenzoquinone, tetracyanobenzene, sulfonic acid, cyanonaphthalene, benzoic acid, nitronaphthalic anhydride, and so forth. The heterocyclic compounds may include 5- to 7-membered ring compounds. Suitable examples of hetero atoms are N, S and O.

In order to add these compounds together with the metallocene compounds to the protective layer, the compounds may be added to a binder solution simultaneously or separately, or in some cases the compounds, which have been previously mixed uniformly, may be added to a binder solution. The application to the photoconductive layer is similar to fabricating other electrophotographic member of the invention described hereinbefore.

The present invention will be particularly illustrated by way of the following examples.

EXAMPLE 1

Amorphous selenium was vacuum deposited on an aluminium substrate in a thickness of 60μ in a conventional manner to give a photoconductive layer. On the layer the ferrocene-organic binder-resin solutions of the following formulation Nos. 1 to 3 were applied by an automatic applicator in a thickness of 15 μm to provide Electrophotographic Members Nos. 1 to 3, respectively.

| | |
|---|---|
| Solution No. 1 | |
| Ferrocene | 10 g |
| Polycarbonate (Panlite, a product of Teijin Chemicals Ltd.) | 100 g |
| Dichloromethane | 1,000 g |
| Solution No. 2 | |
| Ferrocene | 10 g |
| Polyurethane (Polyuremytilac Clear Base, a product of Dai Nippon Toryo Co., Ltd.) | 260 g |
| Solvent (polyuremytilac thinner) | 150 g |
| Solution No. 3 | |
| Ferrocene | 10 g |
| Polyester (Byron, a product of Toyo Spinning Co., Ltd.) | 100 g |
| Dichloromethane | 1,000 g |

The resulting electrophotographic members having the protective layers obtained from Solutions Nos. 1 to 3 were tested in an ordinarily employed electric characteristic measuring apparatus for electrophotography to determine their characteristics. As shown in Table 1 the dark discharge potential (DDP) was large and the residual potential (RP) was small, these potentials being very low in humidity dependence. Further, as indicated in Table 2, no accumulation of electrical charges was observed with regard to the dark discharge potential and residual potential, showing a very good repetitive characteristic.

TABLE 1

| Electro-photographic Member | 20° C. 10% RH DDP (V) | 20° C. 10% RH RP (V) | 20° C. 50% RH DDP (V) | 20° C. 50% RH RP (V) | 20° C. 95% RH DDP (V) | 20° C. 95% RH RP (V) |
|---|---|---|---|---|---|---|
| No. 1 | 850 | 25 | 850 | 25 | 845 | 25 |
| No. 2 | 910 | 40 | 910 | 40 | 900 | 40 |
| No. 3 | 970 | 70 | 970 | 70 | 970 | 70 |

TABLE 2

| Electro-photographic Member | DDP 1 Cycle (V) | DDP 500 Cycles (V) | DDP Δ V (V) | RP 1 Cycle (V) | RP 500 Cycles (V) | RP Δ V (V) |
|---|---|---|---|---|---|---|
| No. 1 | 850 | 850 | 0 | 25 | 25 | 0 |
| No. 2 | 910 | 910 | 0 | 45 | 45 | 0 |
| No. 3 | 970 | 975 | 5 | 70 | 70 | 0 |

EXAMPLE 2

On an aluminium substrate was vacuum deposited amorphous selenium in a thickness of 0.5μ, on which was applied a solution of 1 part by weight of polyvinylcarbazole in 10 parts by weight of tetrahydrofuran in a thickness of 20μ using an applicator.

There were provided solutions containing metallocenes Nos. 4 to 6 as indicated in Table 3 in an amount of 10% by weight of polycarbonate resin (Panlite) and Example 1 was repeated to form protective layers for Electrophotographic Members 4 to 6, respectively. The electrical characteristics of these members were measured similarly to Example 1, with good results shown in Table 3.

TABLE 3

| Electrophotographic Member | 20° C. 50% RH DDP (V) | 20° C. 50% RH RP (V) | 20° C. 95% RH DDP (V) | 20° C. 95% RH RP (V) |
|---|---|---|---|---|
| No. 4 (Ferrocene) | 800 | 45 | 805 | 40 |
| No. 5 (Nickelocene) | 710 | 35 | 705 | 30 |
| No. 6 (Dinitroferrocene) | 810 | 40 | 810 | 40 |

EXAMPLE 3

Example 1 was repeated using resin Solutions Nos. 7 to 9 incorporated with the electron accepting materials indicated below, thereby forming protecting layers for Electrophotographic Members 7 to 9.

| | |
|---|---|
| Solution No. 7 | |
| Ferrocene | 10 g |
| Tetracyanoethylene | 6.9 g |
| Polycarbonate (Panlite, a product of Teijin Chemicals Ltd.) | 170 g |
| Dichloromethane | 1,000 g |
| Solution No. 8 | |
| Ferrocene | 10 g |
| 7,7,8,8-Tetracyanoquinodimethane | 11 g |
| Polyurethane (Polyuremytilac Clear Base, a product of Dai Nippon Toryo Co., Ltd.) | 550 g |
| Solvent (Polyuremytilac thinner) | 320 g |
| Solution No. 9 | |
| Ferrocene | 10 g |
| 2,3-Dichloro-5,6-dicyano-p-benzoquinone | 3.5 g |
| Polyester (Byron, Toyo Spinning Co., Ltd.) | 135 g |
| Dichloromethane | 1,200 g |

Upon comparing the electrical characteristics of the electrophotographic members using the protective layers obtained from Solutions Nos. 7 to 9 with those of the electrophotographic members using the protective layers from Solutions Nos. 1 to 3, it was revealed that the electrical characteristics were superior compared with those using no electron accepting materials.

TABLE 4

| Electrophotographic Member | 20° C. 50% RH DDP (V) | 20° C. 50% RH RP (V) | 20° C. 95% RH DDP (V) | 20° C. 95% RH RP (V) |
|---|---|---|---|---|
| No. 1 | 850 | 25 | 840 | 25 |
| No. 7 | 875 | 0 | 875 | 0 |
| No. 2 | 910 | 45 | 900 | 40 |
| No. 8 | 920 | 5 | 920 | 5 |
| No. 3 | 970 | 70 | 950 | 70 |
| No. 9 | 955 | 10 | 955 | 10 |

While the invention has been described in detail and with reference to specific embodiments, thereof, it will be apparent to one skilled in the art that various changes and modifications can be made therein without departing from the spirit and scope thereof.

What is claimed is:

1. An electrophotographic member in which a photoconductive layer and a protective layer are superposed in order on a photoconductive support, wherein the improvement comprises:

said protective layer comprising at least one metallocene or a compound having at least one metallocene nucleus in its molecular structure and at least one electron acceptor dispersed in a binder resin containing a $$-\underset{\underset{O}{\|}}{C}-$$

bond, said protective layer having a thickness of about 0.5 to 50μ.

2. An electrophotographic member as in claim 1, wherein the metallocene or compound having at least one metallocene nucleus in its molecular structure is present in an amount from about 0.01 to 70 wt%, based on the weight on the protective layer.

3. An electrophotographic member as in claim 1, wherein the metallocene or compound having at least one metallocene nucleus in its molecular structure is present in an amount from about 1 to 50 wt%, based on the weight on the protective layer.

4. An electrophotographic member as in claim 1, 2, or 3, wherein said metallocene is a metallocene of Fe, Ni, Co, V, Cr, or Ti, or said compound having at least one metallocene nucleus in its molecular structure includes Fe, Ni, Co, V, Cr, or Ti in the metallocene nucleus.

5. An electrophotographic member as in claim 1, wherein said electron acceptor is present in an amount of from about 0.001 to 2 mols per mol of metallocene or the compound having at least one metallocene nucleus in its molecular structure.

6. An electrophotographic member as in claim 1, wherein said electron acceptor is selected from the group consisting of phthalic acid anhydride, tetrachlorophthalic acid anhydride, s-tricyanobenzene, picryl chloride, 2,4-dinitrochlorobenzene, 2,4-dinitrobromobenzene, 4-nitrobiphenyl, 4,4-dinitrobiphenyl, 2,4,6-trinitroanisole, trichlorotrinitrobenzene, trinitro-o-toluene, 4,6-dichloro-1,3-dinitrobenzene, p-dinitrobenzene, chloranyl, bromanyl, tetracyanoethylene, hexacyanobutadiene, tetracyanoquinodimethane, benzoquinone and halo- or cyano-derivatives thereof, aromatic or heterocyclic compounds substituted with a nitro group, a sulfo group, a carboxyl group, or a cyano group, and monomers or polymers of 2,4,7-trinitro-9-fluorenone, 2,4,5,7-tetranitrofluorenone, trinitroanthracene, dinitroacridine, tetracyanopyrene, and dinitroanthraquinone.

7. An electrophotographic member as in claim 5, wherein said electron acceptor is selected from the group consisting of phthalic acid anhydride, tetrachlorophthalic acid anhydride, s-tricyanobenzene, picryl chloride, 2,4-dinitrochlorobenzene, 2,4-dinitrobromobenzene, 4-nitrobiphenyl, 4,4-dinitrobiphenyl, 2,4,6-trinitroanisole, trichlorotrinitrobenzene, trinitro-o-toluene, 4,6-dichloro-1,3-dinitrobenzene, p-dinitrobenzene, chloranyl, bromanyl, tetracyanoethylene, hexacyanobutadiene, tetracyanoquinodimethane, benzoquinone and halo- or cyano- derivatives thereof, aromatic or heterocyclic compounds substituted with a nitro group, a sulfo group, a carboxyl group, or a cyano group, and monomers or polymers of 2,4,7-trinitro-9-fluorenone, 2,4,5,7-tetranitrofluorenone, trinitroanthracene, dinitroacridine, tetracyanopyrene, and dinitroanthraquinone.

8. An electrophotographic member as in claim 1, 2, or 3, wherein said binder resin is a polyurethane resin, or a polyester resin.

9. A process for forming a latent image using an electrophotographic member as in claim 1, 2 or 3, wherein said member is first uniformly charged and then imagewise exposed.

10. An electrophotographic member as in claim 1, wherein said protective layer is 15 to 50$\mu$ thick.

* * * * *